US011040826B1

(12) United States Patent
Williams

(10) Patent No.: US 11,040,826 B1
(45) Date of Patent: Jun. 22, 2021

(54) PORTABLE HAZARDOUS SPILL GROUND CONTAINMENT SYSTEM

(71) Applicant: Floyd E. Williams, Grand Junction, CO (US)

(72) Inventor: Floyd E. Williams, Grand Junction, CO (US)

( * ) Notice: Subject to any disclaimer, the term of this patent is extended or adjusted under 35 U.S.C. 154(b) by 12 days.

(21) Appl. No.: 16/683,596

(22) Filed: Nov. 14, 2019

(51) Int. Cl.
*E02D 31/00* (2006.01)
*B65D 90/24* (2006.01)
*E04H 7/02* (2006.01)

(52) U.S. Cl.
CPC ..... *B65D 90/24* (2013.01)

(58) Field of Classification Search
CPC ..... B65D 90/24; E02B 3/106; E04H 17/168
See application file for complete search history.

(56) References Cited

U.S. PATENT DOCUMENTS 830,437 A * 9/1906 Humphrey ..... E02B 3/106 405/113
3,143,122 A * 8/1964 Goodrich ..... E04H 4/10 135/87
6,042,301 A * 3/2000 Sovran ..... E02B 7/22 405/112
6,443,655 B1 * 9/2002 Bennett ..... E02B 3/106 256/13
6,884,002 B1 * 4/2005 Fuller ..... E02B 7/22 405/114
7,364,385 B1 * 4/2008 Luke ..... E02B 3/102 405/107
2013/0108371 A1 * 5/2013 Marshall ..... B65D 90/24 405/114
2014/0105687 A1 * 4/2014 Southworth ..... E02D 5/54 405/107
2015/0089888 A1 * 4/2015 Chew ..... E04H 9/145 52/202

* cited by examiner

*Primary Examiner* — Frederick L Lagman
*Assistant Examiner* — Stacy N Lawson
(74) *Attorney, Agent, or Firm* — Edwin H. Crabtree; Ramon L. Pizarro

(57) ABSTRACT

A portable hazardous spill or waste water, ground containment system adapted for receipt on a ground surface. The containments system can have various geometric configurations, such as a circle shape or an oval shape. The containment system includes a plurality of spaced apart, vertical metal posts and a plurality of horizontal plastic straps. The straps are disposed one on top of each other. The vertical metal posts are used to hold the plastic straps around a circumference of the containment system. A plastic liner is disposed over the ground surface inside the containment system. A top portion of the liner is attached to a top of the vertical metal posts. The liner is adapted for receiving various types of equipment, tanks and containers holding different types of toxic chemicals, waste water, and other liquid materials.

20 Claims, 4 Drawing Sheets

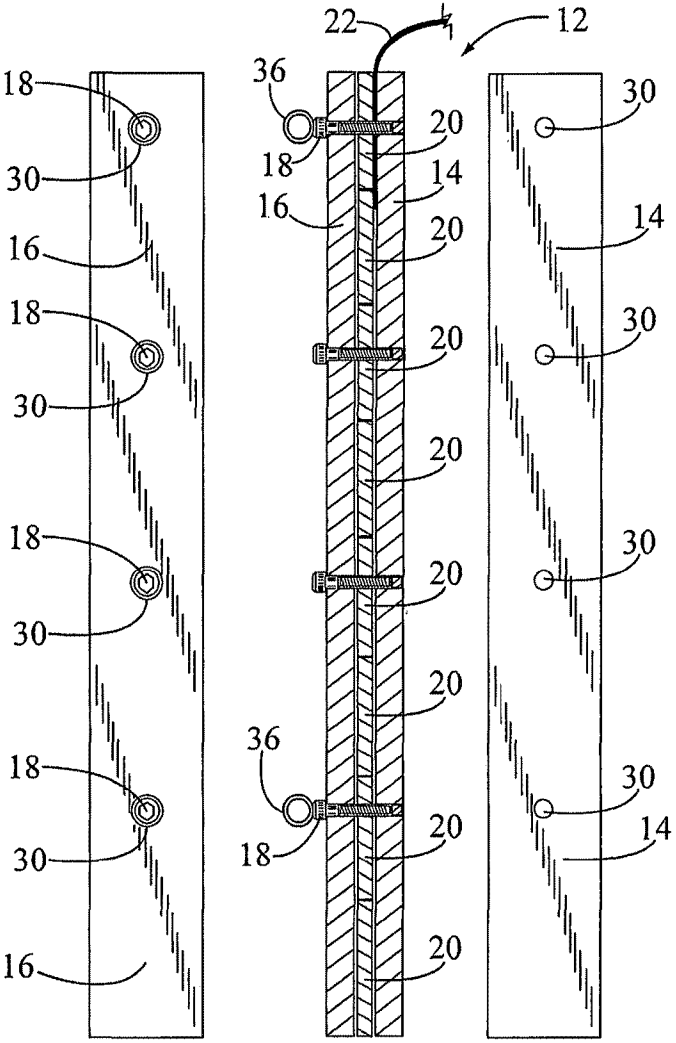
FIG. 4A
FIG. 4
FIG. 4B
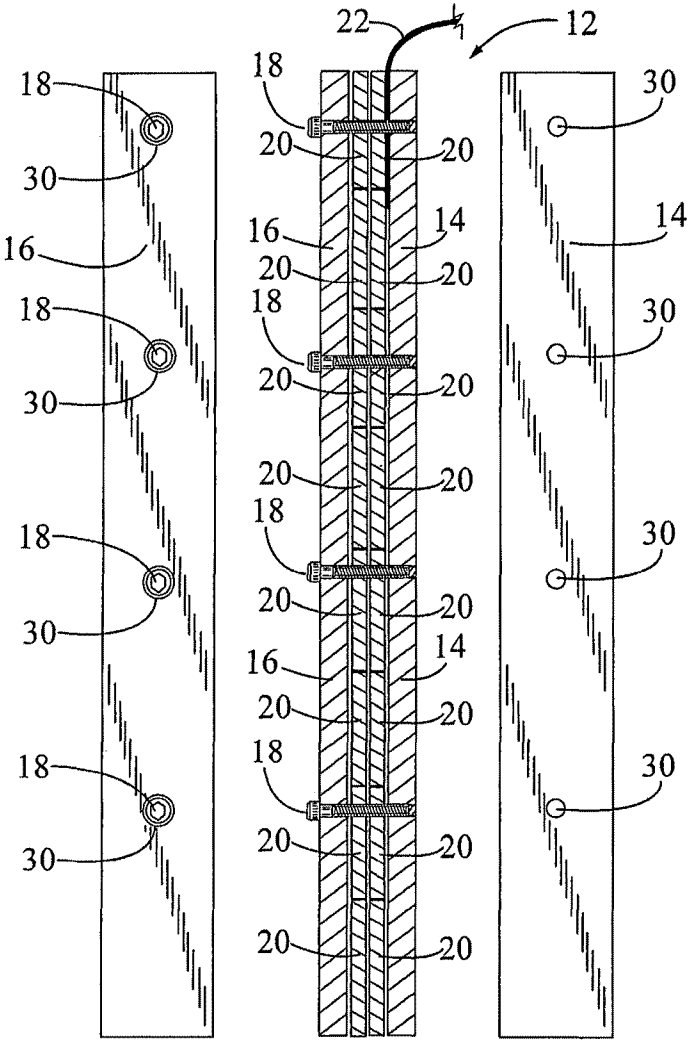
FIG. 3A
FIG. 3
FIG. 3B

PORTABLE HAZARDOUS SPILL GROUND CONTAINMENT SYSTEM

BACKGROUND OF THE INVENTION

(a) Field of the Invention

This invention relates to a portable containment system for collecting and holding in place a leaking hazardous material, waste water, and the like and more particularly, but not by way of limitation, to a portable hazardous spill ground containment system. The system used for placing on a ground surface and under and around equipment, tanks and storage containers used during and after an oil and gas drilling operation or storing waste water to be treated. Also, the system can be used in other industries for similar applications.

(b) Discussion of Prior Art

Heretofore, little thought has been given to leakage of chemicals and toxic materials in and around an oil and gas drilling operation, tank farms and the like. But, with today's environmental concerns related to the possibility of a hazardous material contaminating a ground surface, leaking into nearby ponds, streams and lakes, migrating into an underground aquifer, killing wildlife and damaging foliage, new environmental laws and regulations, passed by the EPA, now require the oil and gas industry to include some type of ground containment system around a drilling site to collect spillage before it contacts the ground surface or face a large fine and/or stopping the operation.

Currently, ground containment barriers are built with an earth berm or straw bales and the like and disposed around drilling equipment and storage tanks with a heavy tarp spread across the ground surface with the sides of the tarp received over the top of the berm or the straw bales. This type of structure is obviously not portable, reusable or particularly reliable. Also, this type of structure doesn't hold the tarp securely in place on the ground surface.

The subject invention is similar to what is disclosed in U.S. Pat. No. 8,636,445 to the subject inventor. In this patent, a containment system provides for a high strength, light weight metal, portable, variable size, ground containment system that can be quickly assembled for holding a heavy liner securely on a ground surface. The system can then be disassembled for reuse when the drilling operation is completed. The subject invention, as described, is more portable, easier to assemble, and can be configured into various geometric configurations, such as a circle or oval, for receipt around fluid storage equipment.

SUMMARY OF THE INVENTION

In view of the foregoing, it is a primary objective of the subject invention to provide a portable containment system, which includes light weight, spaced apart, vertical, angular-shaped metal posts used to hold a plurality of plastic horizontal straps and hold a heavy plastic liner in place. The vertical metal posts can range in height from 4 to 6 feet and greater.

Another object of the invention is the containment system can be made for creating various geometric sizes of an annular-shaped containment area. The containment area can be used for covering various types of ground surfaces.

Still another object of the containment system is the vertical posts and horizontal straps hold a heavy liner securely on a ground surface to prevent movement of the liner when equipment is placed thereon and prevent movement of the liner during cleanup of a toxic spill or treating waste water in the containment area.

Yet another key advantage of the portable containment system is it eliminates the need for pit excavation and land reclamation and without requiring a permanent permit for its use.

Still further, the portable containment system can be used not only in the gas and oil industry, but in other industries where equipment and tanks are subject to toxic spills or liquid waste on different types of indoor and outdoor surfaces.

The subject portable hazardous spill ground containment system includes a plurality of spaced apart vertical metal posts used to hold a plurality of horizontal plastic straps, disposed one of top of the other. Also, the posts are used to hold a plastic liner in place on a ground surface. The liner is adapted for receiving various types of equipment, tanks and containers holding various types of toxic chemicals, waste water, and other liquid materials.

These and other objects of the present invention will become apparent to those familiar with various types of outdoor and indoor containment systems used to hold and contain spillage of hazardous liquids and material and prevent contaminating a ground or floor surface when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject portable ground containment system for collecting and holding spilled hazardous materials and other liquids, and in which:

FIG. 3 illustrates a sectional view taken along lines 3-3 of a vertical post and horizontal straps, shown in FIG. 1, FIGS. 3A and 3B illustrate front views of an inside post and an outside post, shown in FIG. 3.

FIG. 4 illustrates a sectional view taken along lines 4-4 of a vertical post and horizontal straps, shown in FIG. 1, FIGS. 4A and 4B illustrate front views of an inside post and an outside post, shown in FIG. 4.

DETAILED DESCRIPTION OF THE PREFERRED EMBODIMENTS

Figure 1:
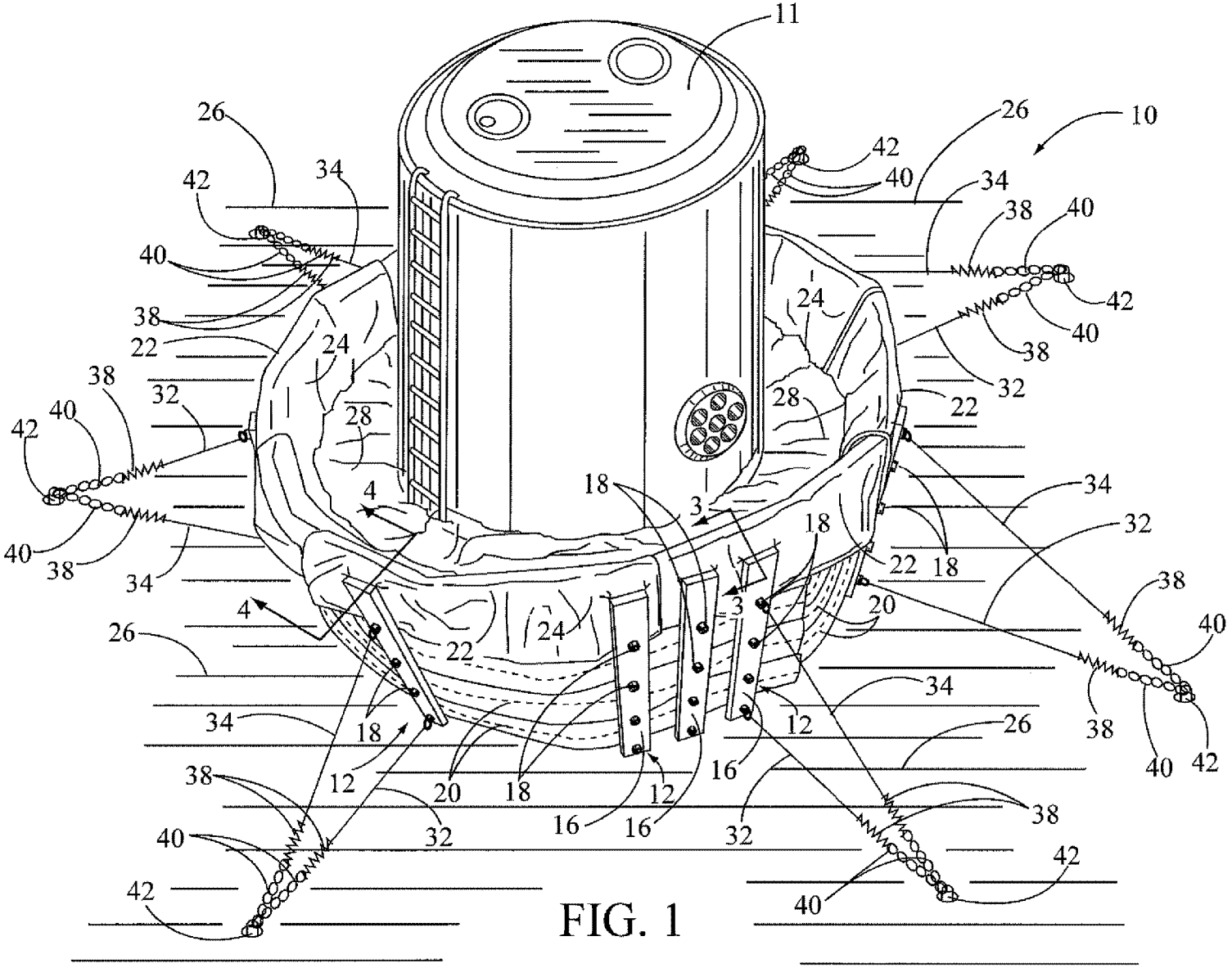
FIG. 1 is a perspective view of the subject portable ground containment system and shown surrounding a large annular-shaped, portable storage tank used to hold oil, waste water, or chemicals used in an oil and gas drilling and fracing operation.

In FIG. 1, the subject portable hazardous spill ground containment system is shown having general reference numeral 10. In this drawing, the system 10 has an annular shape for receipt around, in this example, a large waste water storage tank 11.

The ground containment system 10 includes a plurality of spaced apart, vertical, angular-shaped, metal posts, having general reference numeral 12. Each post 12 includes a inside post 14, shown in FIG. 2, and an identical outside post 16 disposed next to each other and secured to each other using spaced apart, threaded post screws 18. The inside post 14 and outside post 16 are used for receiving and holding parallel, horizontal plastic straps 20 disposed therebetween with one on top of the other for creating a selected height for the overall system 10.

The straps 20 can have a width in a range of 2 to 4 inches and can vary in length. The length of the straps 20 can extend around the circumference of the containment system, with opposite ends of the straps secured between a metal post, as shown in FIG. 4. Also, the two posts 14 and 16 are used to hold a folded top portion 22 of a heavy plastic liner 24. The metal posts 12 are typically 4 to 8 feet in length and have a width in a range of 1 to 1½ inches In this drawing, the liner 22 has been placed on top of a ground surface 26 and attached to the top of the vertical posts 12. The vertical posts 12 have been placed around a circumference of the ground containment system 10. Also, liquid waste water 28 is shown being held inside the containment system 10 and next to the storage tank 11.

Figure 2:
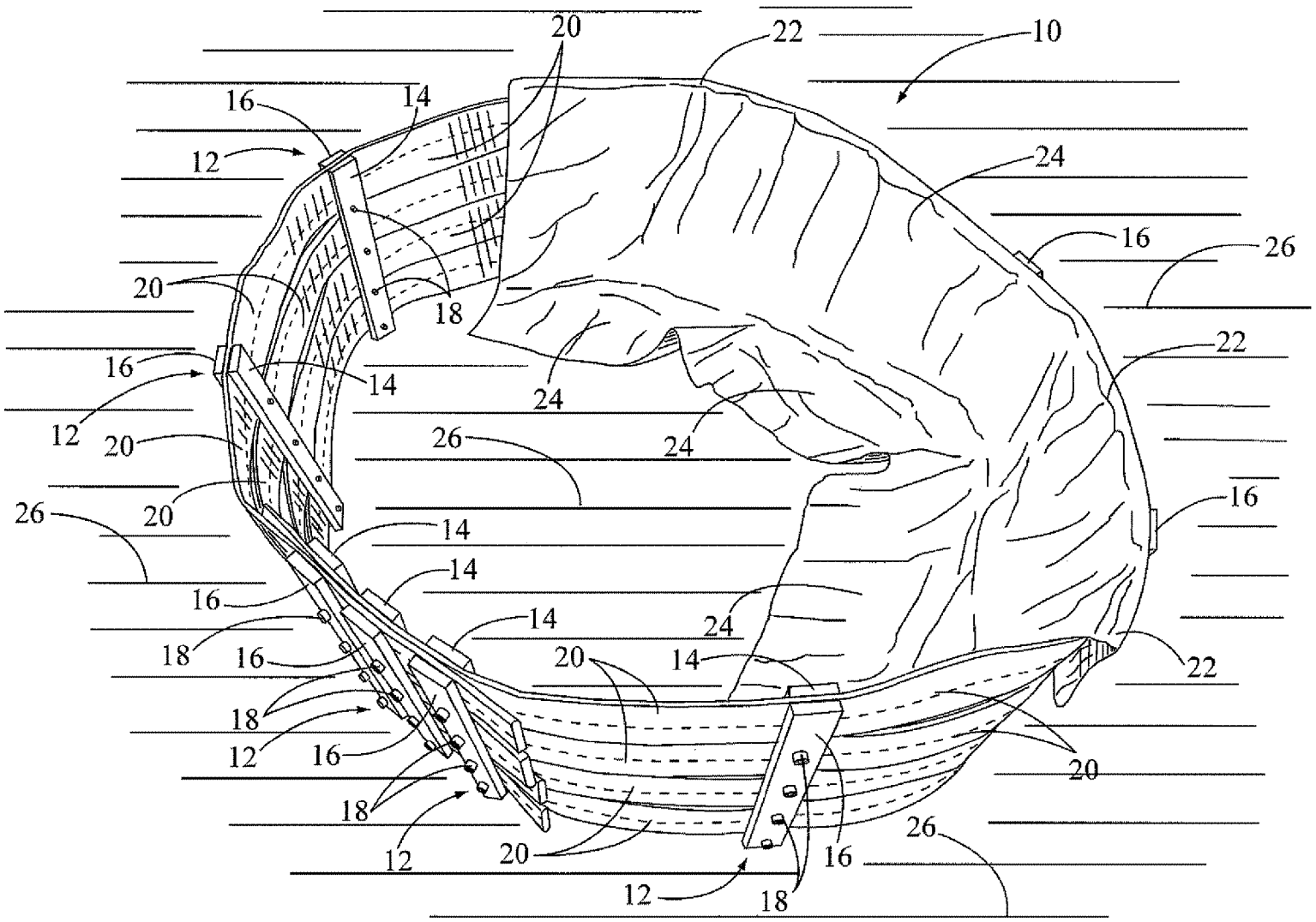
FIG. 2 is another perspective view of the containment system shown in FIG. 1 with sections of a heavy plastic liner place on a ground surface and prior to heat sealing the liner together in one piece.

In FIG. 2, another perspective view of the containment system 10 is shown with sections of the heavy plastic liner 24 place on the ground surface 26 and prior to heat sealing the liner together in one piece. When the liner 24 has been sealed, the top portion 22 of the liner is secured to the top of the posts 12. The system 10 is now ready for receiving a storage tank or similar storage container inside it's perimeter.

In FIG. 3, a cross sectional view is shown, taken along lines 3-3, of a vertical post 12 and horizontal straps 20, as shown in FIG. 1, In this view, adjacent pairs of the straps 20 are shown compressed together between an inside post 14 and an outside post 16 using the post screws 18 for securing the posts together. Also, the top portion 22 of the liner is shown secured between the top of the inside post 14 and the top of the outside post 16.

In FIG. 3A, a front view of the inside post 14 is shown having spaced apart post screw holes 30 along a length of the post. The screw holes 30 are used for receiving ends of the post screws 18.

In FIG. 3B, a front view of the outside post 14 is shown having spaced apart post screws 18 along a length of the post. The outside post 14 also includes spaced apart post screw holes 30 for receiving the post screws 18 therethrough.

In FIG. 4, a cross sectional view is shown, taken along lines 4-4, of a vertical post and horizontal straps, as shown in FIG. 1. In this view, the straps 20, one on top of the other, are shown compressed together between an inside post 14 and an outside post 16 using the post screws 18 for securing the posts together. Also, the top portion 22 of the liner 24 is shown secured between the top of the inside post 14 and the top of the outside post 16.

In FIG. 4A, a front view of the inside post 14 is shown having spaced apart post screw holes 30 along a length of the post. The screw holes 30 are used for receiving ends of the post screws 18.

In FIG. 4B, a front view of the outside post 14 is shown having spaced apart post screws 18 along a length of the post.

Figure 5:
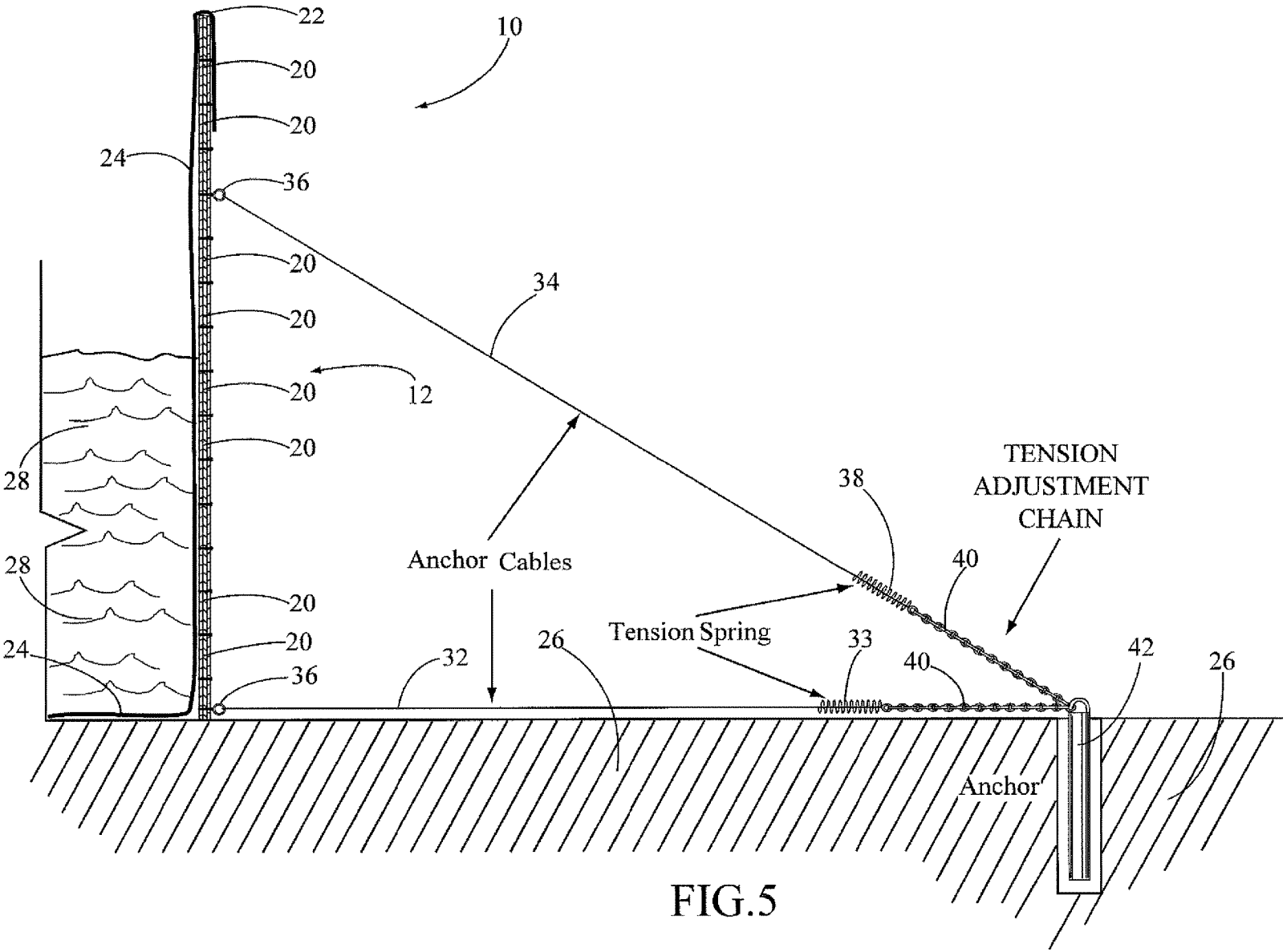
FIG. 5 is a side view of one of the vertical metal posts held in place using anchor cables and a ground anchor. Also, waste water is shown on top of the ground surface liner and being held inside the containment system.

In FIG. 5, a side view of one of the vertical metal posts 12 is shown and held in place using a ground anchor cable 32 and an angled anchor cable 34. One end of the cables 32 and 34 are attached to eyelets 36. The eyelets 36 are attached to post screws 18 disposed at the bottom of the posts and at a selected height on the posts, as shown in this drawing. An opposite end of the cables 32 and 34 are attached to one end of a tension spring 38. An opposite end of the tension springs 38 is attached to a tension adjustment chain 40. The tension springs and tension adjustment chains on the cables 32 and 34 are used for adjusting the tension placed on the vertical posts. An opposite end of the tension adjustment chains 40 is attached to a ground anchor 42. The tension springs 38 and the tension adjustment chains 40 are used to hold the post 12 upright and in a vertical position.

In this drawing, waste water 28 is shown on top of a ground surface liner plastic liner 24 and being held in inside the containment system 10. In should be noted, the cables 32 and 34, tension springs 38, tension adjustment chains 40, and ground anchors 42 are shown in FIG. 1, disposed around the circumference of the containment system 10 for holding the vertical posts 12 in place.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right are claimed and defined as follows:

1. A portable, hazardous spill or waste water, ground containment system adapted for receipt on a ground surface, the containment system having an annular shaped configuration, the containment system comprising:

a plurality of spaced apart, vertical metal posts;

a plurality of horizontal non-linear or curved plastic straps, the straps disposed one on top of the other and thereagainst for forming a vertical wall, the vertical metal posts used to hold the plastic straps around a circumference of the containment system; and a plastic liner having a top portion attached to a top of the vertical metal posts, the plastic liner adapted for covering the ground surface within an area inside the circumference of the containment system, also, the liner adapted for receiving equipment, tanks and containers holding toxic chemicals, waste water, and other liquid materials, the liner adapted for holding leakage thereon and from the equipment, tanks and containers.

2. The containment system as described in claim 1 wherein each of the metal posts includes an inside post and an identical outside post, the inside post and the outside post coupled together using post screws.

3. The containment system as described in claim 2 wherein the horizontal straps are received one on top of the other between the inside post and the outside post and compressed therebetween using the post screws.

4. The containment system as described in claim 2 wherein the plastic liner covers the inside post.

5. The containment system as described in claim 1 further including anchor cables, wherein ends of the anchor cables are attached to the vertical posts for holding the posts in an upright position.

6. The containment system as described in claim 5 further including ground anchors adapted for receipt in the ground surface, wherein opposite ends of the anchor anchors are attached to the ground cables.

7. The containment system as described in claim 6 further including a tension spring and a tension adjustment chain attached to the anchor cables for adjusting the tension placed on the vertical posts.

8. A portable, hazardous spill or waste water, ground containment system adapted for receipt on a ground surface, the containment system having an annular shaped configuration, the containment system comprising:

a plurality of spaced apart, vertical metal posts, the posts having spaced apart post screw holes along a length thereof for receiving post screws;

a plurality of horizontal non-linear or curved plastic straps, the straps disposed one on top of the other and thereagainst for forming a vertical wall, the vertical metal posts used to hold the plastic straps around a circumference of the containment system; and a plastic liner having a top portion attached to a top of the vertical metal posts, the plastic liner adapted for covering the ground surface within an area inside the circumference of the containment system, also, the liner adapted for receiving equipment, tanks and containers holding toxic chemicals, waste water, and other liquid materials, the liner adapted for holding leakage thereon and from the equipment, tanks and containers.

9. The containment system as described in claim 8 wherein each of the metal posts includes an inside post and an identical outside post, the inside post and the outside post coupled together using the post screws.

10. The containment system as described in claim 9 wherein the horizontal straps are received one on top of the other between the inside post and the outside post and compressed therebetween using the post screws.

11. The containment system as described in claim 9 wherein the plastic liner covers the inside post.

12. The containment system as described in claim 8 further including anchor cables, wherein ends of the anchor cables are attached to the vertical posts for holding the posts in an upright position.

13. The containment system as described in claim 12 further including ground anchors adapted for receipt in the ground surface, wherein opposite ends of the anchor anchors are attached to the ground cables.

14. The containment system as described in claim 12 further including a tension spring and a tension adjustment chain attached to each of the anchor cables for adjusting the tension placed on the vertical posts.

15. A portable, hazardous spill or waste water, ground containment system adapted for receipt on a ground surface, the containment system having an annular shaped configuration, the containment system comprising:

a plurality of spaced apart, vertical metal posts, the posts having spaced apart post screw holes along a length thereof for receiving post screws, each of the metal posts including an inside post and an identical outside post, the inside post and the outside post coupled together using the post screws;

a plurality of horizontal non-linear or curved plastic straps, the straps disposed one on top of the other and thereagainst for forming a vertical wall, the vertical metal posts used to hold the plastic straps around a circumference of the containment system; and a plastic liner having a top portion attached to a top of the vertical metal posts, the plastic liner adapted for covering the ground surface within an area inside the circumference of the containment system, also, the liner adapted for receiving equipment, tanks and containers holding toxic chemicals, waste water, and other liquid materials, the liner adapted for holding leakage thereon and from the equipment, tanks and containers.

16. The containment system as described in claim 15 wherein the plastic liner covers the inside post.

17. The containment system as described in claim 15 further including anchor cables, wherein ends of the anchor cables are attached to the vertical posts for holding the posts in an upright position.

18. The containment system as described in claim 17 further including ground anchors adapted for receipt in the ground surface, wherein opposite ends of the anchor anchors are attached to the ground cables.

19. The containment system as described in claim 17 further including a tension spring and a tension adjustment chain attached to each of the anchor cables for adjusting the tension placed on the vertical posts.

20. The containment system as described in claim 17 wherein the plastic straps have a width in a range of 2 to 4 inches and a length extending around the circumference of the containment system.

* * * * *